US006676164B1

(12) United States Patent
Patton et al.

(10) Patent No.: US 6,676,164 B1
(45) Date of Patent: Jan. 13, 2004

(54) PERSONAL POSTAL PRODUCT

(75) Inventors: David L. Patton, Webster, NY (US); James R. Forger, Jr., Spencerport, NY (US); H. M. Delman, Fairport, NY (US); Frank Pincelli, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 276 days.

(21) Appl. No.: 09/641,112

(22) Filed: Aug. 17, 2000

(51) Int. Cl.[7] ..... B42D 15/00
(52) U.S. Cl. ..... 283/71; 283/101; 283/105
(58) Field of Search ..... 283/71, 101, 105, 283/107, 109, 110, 111; 40/638

(56) References Cited

U.S. PATENT DOCUMENTS 4,640,030 A 2/1987 Wood et al.
4,872,706 A * 10/1989 Brewen et al. ..... 283/71 X
4,895,747 A * 1/1990 Birkholz et al. ..... 283/71
5,044,669 A 9/1991 Berry
5,090,736 A * 2/1992 Minkus ..... 283/77
D327,370 S 6/1992 Mittelstrass
5,423,573 A * 6/1995 de Passille ..... 283/71
5,806,895 A 9/1998 Sharabani
5,836,617 A 11/1998 Beaudoin et al.
5,848,810 A * 12/1998 Beaudoin et al. ..... 283/71 X
5,873,605 A * 2/1999 Kaplan ..... 283/71
5,923,406 A 7/1999 Brasington et al.
6,123,361 A * 9/2000 Cohen ..... 283/71 X

FOREIGN PATENT DOCUMENTS

EP 1172226 * 1/2002 ..... 283/77

* cited by examiner

*Primary Examiner*—Willmon Fridie, Jr.
(74) *Attorney, Agent, or Firm*—Frank Pincelli

(57) ABSTRACT

An official postal product that can be placed over a personal image without substantially detracting from the viewing of the personal image.

6 Claims, 14 Drawing Sheets

PERSONAL POSTAL PRODUCT

FIELD OF THE INVENTION

The present invention provides a method and article for making a personal postal product by modifying an official postal product such as a stamp so that when the stamp is affixed to the personal image portion of the personal postal product the stamp but does not detract from the personal image.

BACKGROUND OF THE INVENTION

In 1982, a Texas firm called American Discount Stamps proposed to combine postage stamps with advertising matter. A gummed stamp was affixed to a 2-inch by 3-inch label bearing a printed advertisement that had adhesive on the back. Users would affix the entire label containing the affixed stamp to an envelope or parcel. The system is disclosed U.S. Pat. No. 4,872,706. In the art previously described a conventional stamp was used. No attempt was made to make the official portion of the postage either blend into the image on the label or to reduce the size of the stamp or provide a stamp with only the basic information such as the stamp denomination and country.

A very similar postal product is disclosed in U.S. Pat. No. 5,423,573 were a personal image is printed as a separate sticker and adhered directly to an official stamp in a designated area. As described in articles in the hobby press the U.S. Pat No. 5,423,573 patent is almost identical to a scheme from the $19^{th}$ century. From 1876 to 1886, the U.S. Post Office Department permitted so-called advertising collars to be printed around the embossed stamps on stamped envelopes.

U.S. Pat. No. 5,873,605 discloses creating a postage stamp using an electronic camera to capture an image of oneself via a vending machine. Likewise U.S. Pat. No. 5,923,406 discloses producing a postage stamp using an electronic camera and a vending machine. In both cases a personal image is captured by an electronic camera in a kiosk and printed in a designated area on and official postal product. In each case of the prior art disclosed the personal image is affixed to or printed on the official stamp where the stamp is still a prominent feature.

In co-pending patent Application entitled "MODIFICATION OF RECEIVER SURFACE TO REJECT STAMP CANCELLATION INFORMATION" of Patton et.al Ser. No. 09/605,246, filed on Jun. 28, 2000, there is disclosed a system used for creating a coating on an image produced by a thermal printer, wax sublimation printer, electrophotographic printer or inkjet printer, with a layer of material that produces a surface capable of rejecting information transferred by a stamp canceling device.

At present official postage stamps are designed to accept a cancellation mark as the stamp passes through the postal sorting equipment. The cancellation mark shows the stamp has been used as postage on a piece of mail and cannot be used again. Because of the nature of the equipment used to print the cancellation mark no attempt is made to place the cancellation mark other than to ensure the mark is printed across a portion of the stamp. The cancellation mark extends across the official postal area of the stamp as well as the personal image area thus obscuring as well as marring the personalized portion.

There are several problems that are not addressed by the prior art. The first problem is no attempt is made to construct the official postal product so that it can be affixed to the personal image in a non-obtrusive manner.

Secondly, the user is offered no choice as to where the official postage stamp may be placed in relationship to the personal image.

Finally, the prior art provides the personal image no protection from the cancellation mark using the existing postal cancellation methods.

The present invention provides a method and article for making a personal postal product by modifying an official postal product such as a stamp so that when the stamp is affixed to the personal image portion of the personal postal product the stamp but does not detract from the personal image.

SUMMARY OF THE INVENTION

In accordance with one aspect of the present invention there is provided an official postal product comprising a planner support structure, the support structure being substantially clear and an official postal indicia comprising only a portion of the support structure, the official postal indicia being placed on the planar support structure and is in the form of individual letters, numbers and/or symbols.

In another aspect of the present invention there is provided a postal assembly comprising a first planner support structure being a top surface and having a personal image thereon. An official postal product having a second planner support, the second support structure being substantially clear. The official postal product adapted to be placed on the personal image on the first planner support structure.

In accordance with yet anther aspect of the present invention there is provided a method for making an official postal product, comprising the steps of:

providing a support structure, placing an official postal indicia on said support structure using a dry transfer for transferring of the postal indicia on to the support structure.

In accordance with another aspect of the present invention there is provided an official postal product comprising a plurality of individual letters, numbers and/or symbols that are connected together to form.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
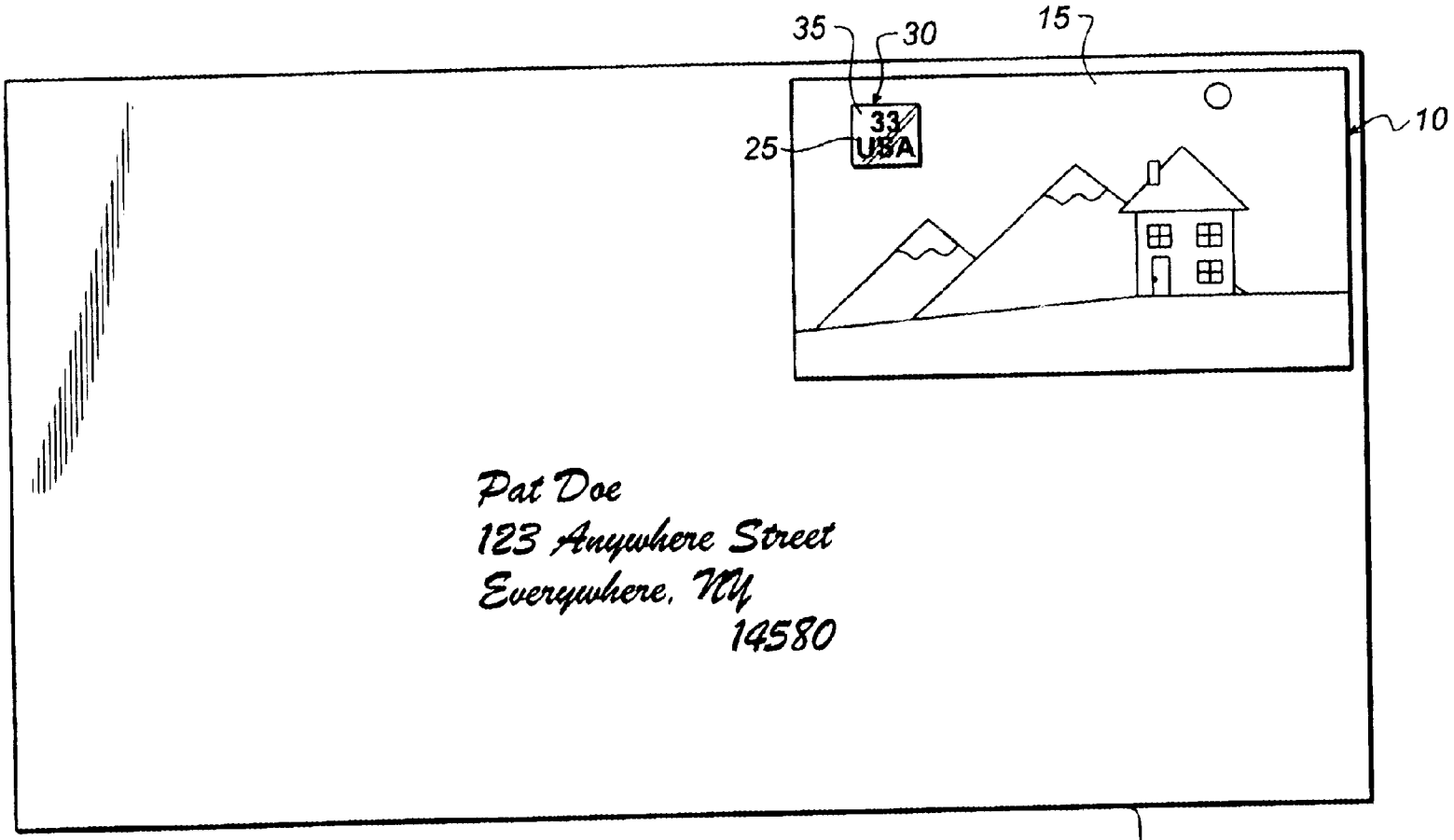
FIG. 1 is a plan view of an envelope affixed with a personal postal product made in accordance with the present invention.

Referring now to FIG. 1, there is illustrated a plan view of an envelope 5 affixed with a personal postal product 10 comprising a personal image 15 or in the case of a business an advertisement or logo. The personal postal product 10 also having an official postal product 30 which in the embodiment illustrated is a stamp. The official postal product includes an official postal indicia 25 printed thereon. The official postal indicia 25 can be monetary, a country and other required official symbols. The official postal indicia 25 can also be an image such as is on a regular postage stamp. The official postal indicia 25 is printed in accordance to the specifications given in USPS-P-1238D, Jun. 27, 1997 onto a transparent support 35. Preferably the support 35 is substantially clear. However if desired the support 35 may be translucent or of a color that allows viewing of the personal image underneath. An example of a typical transparent support capable of accepting a cancellation mark is 3M Transparency Film for inkjet printers (part number CG3410).

Figure 2:
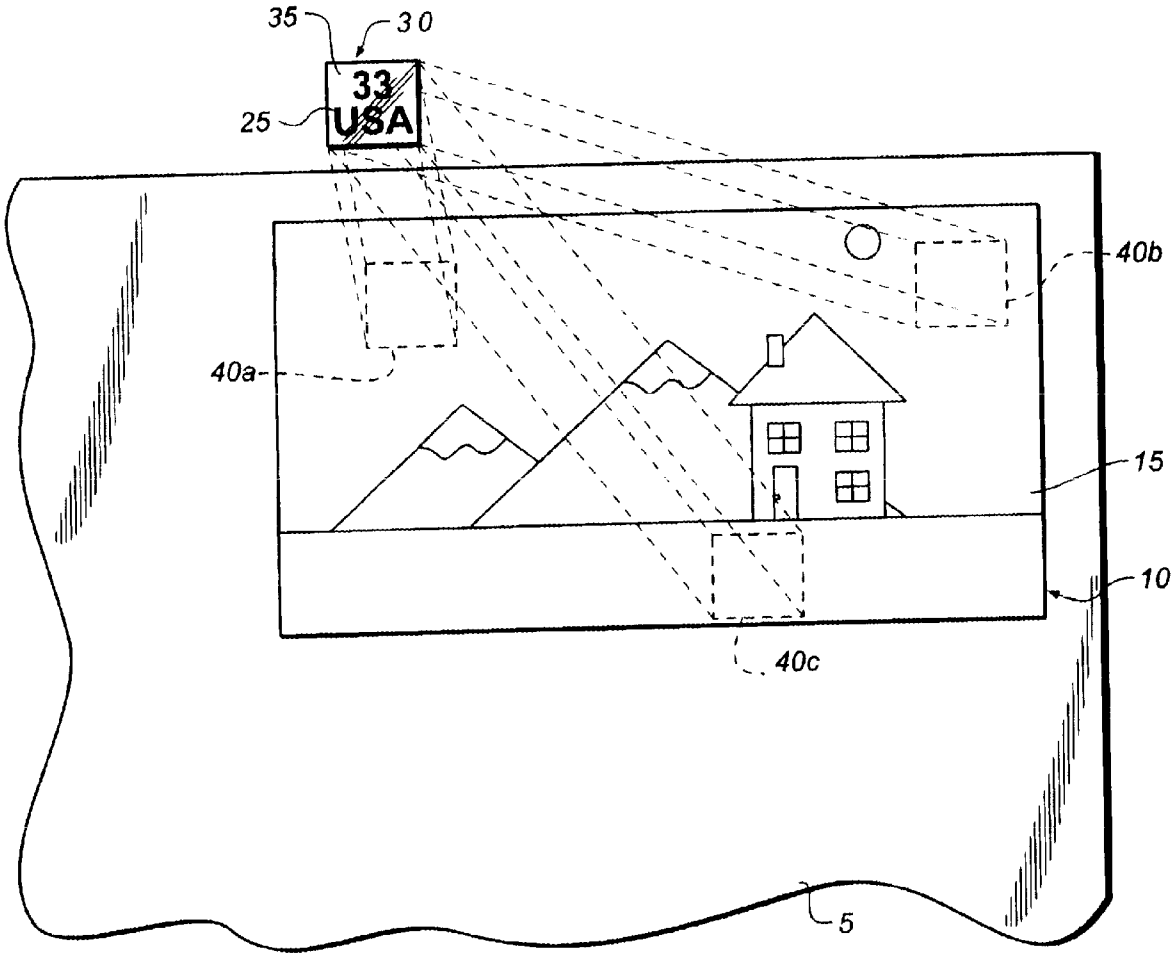
FIG. 2 is an enlarged exploded view of the envelope illustrating where the stamp may be placed.

Referring now to FIG. 2, there is illustrated an enlarged plan view of the envelope 5 affixed with a personal postal product 10 containing a personal image 15. The official postal product 30 with the official postal indicia 25 printed thereon maybe affixed anywhere within the personal image 15 as indicated by the dashed rectangles 40*a*, 40*b*, and 40*c*. This allows the user to choose the most favorable place on the personal image 15 for placement of the postal indicia 25.

Figure 3:
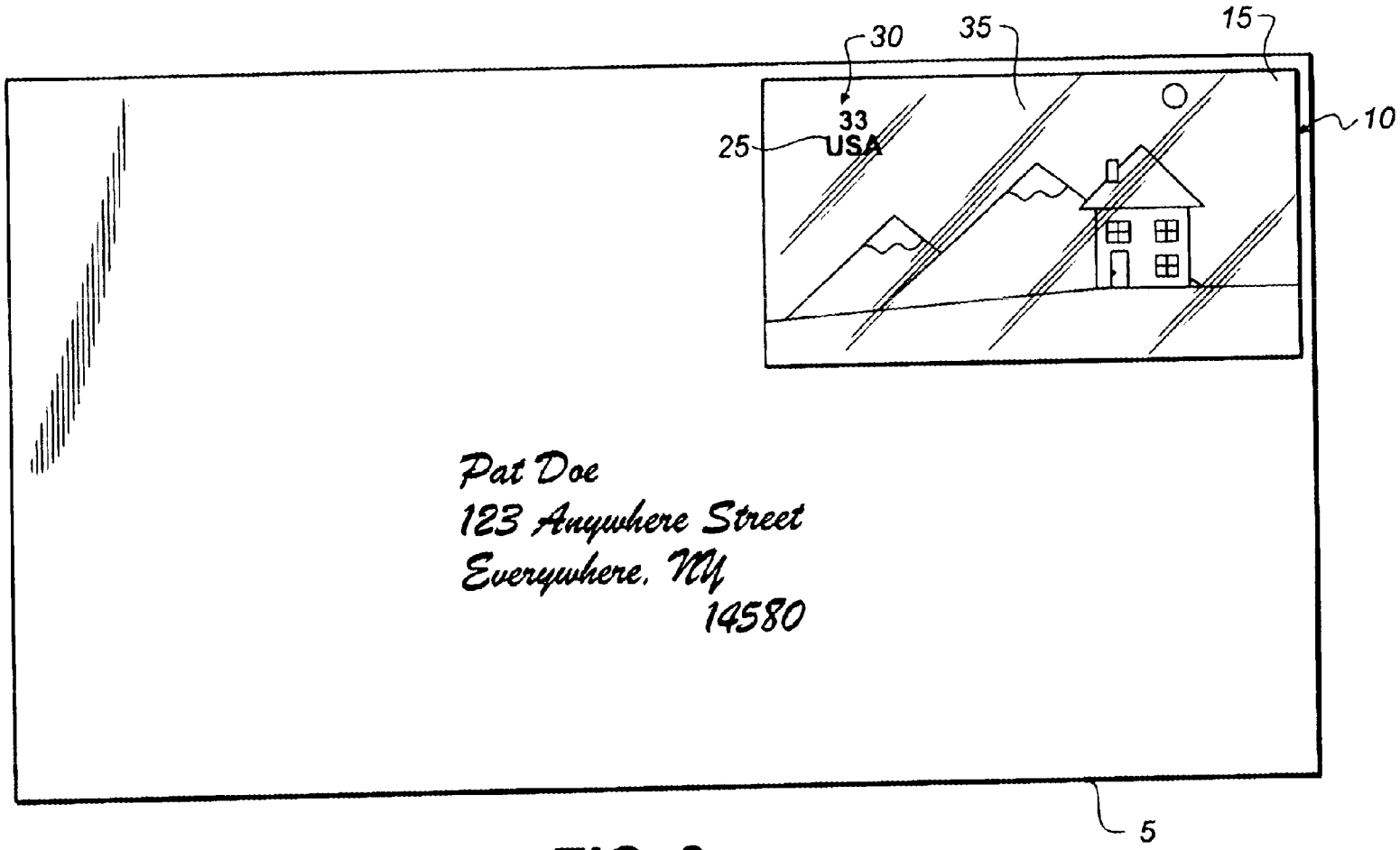
FIG. 3 is an plan view of an envelope affixed with a modified personal image and an official postal image made in accordance with the present invention.

Referring now to FIG. 3, there is illustrated a plan view of an envelope 5 affixed with a personal postal product 10 containing a personal image 15 and an official postal indicia 25. As previously discussed in FIG. 1 like numerals indicating like parts and operations. The personal postal product 10 having a official postal product 30 with official postal indicia 25 printed on the transparent support 35. The official postal product 30 is sized to cover the entire area of the personal image 15. Is of course to be understood that the personal image may be printed directly on an envelope, card or other support structure and the official postal product placed over the personal image.

Figure 4A:
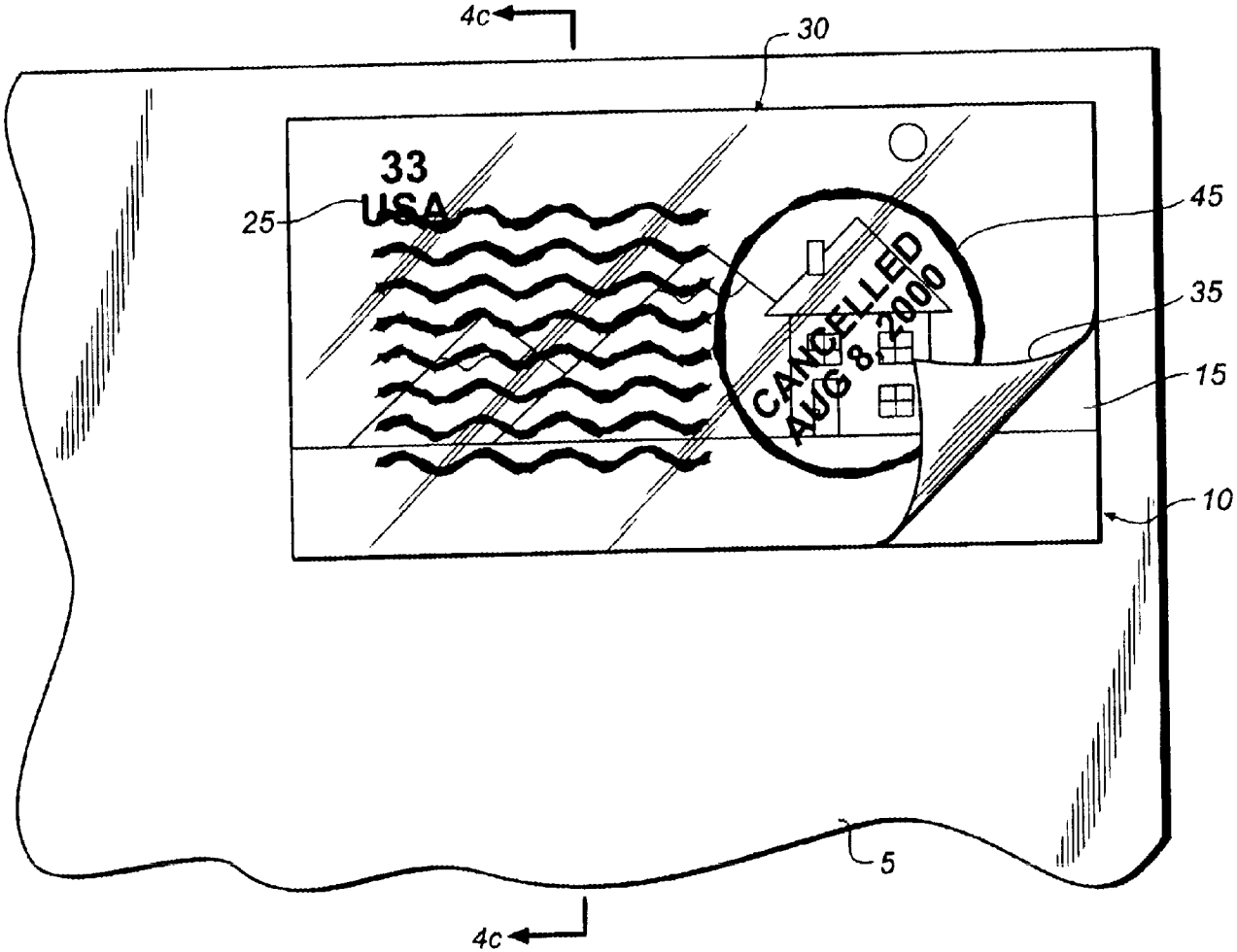
FIG. 4*a* and FIG. 4*b* are an enlarged partial views of an envelope affixed with a personal image and an official postal image made in accordance with the present invention.
Figure 4B:
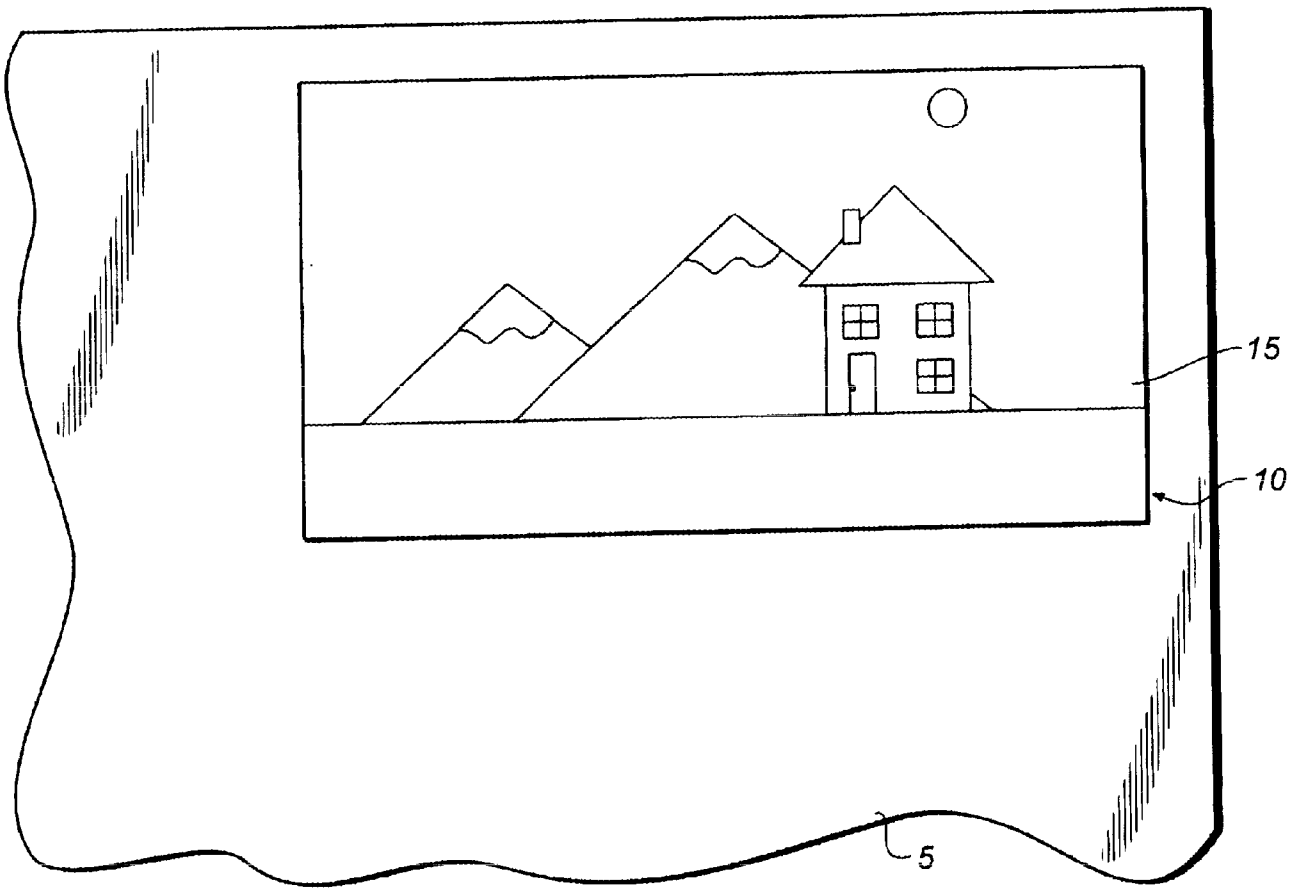

Referring now to FIGS. 4*a* and 4*b*, there are illustrated enlarged partial views of an envelope 5 affixed with the personal postal product 10 shown in FIG. 3. During the mail delivery process a stamp cancellation device (not shown) prints a cancellation mark 45 on the entire surface of the official postal product 30. The cancellation mark 45 extends across the official postal indicia 25 of the official postal product 30 as well as the personal image 15 thus obscuring the personalized portion. A typical official United States postage stamp is printed with inks that have a pigment, when excited by ultraviolet light at a peak wavelength of 254 nanometers, phosphoresce in the visible (green) region of the spectrum with a peak wavelength of 526 nanometers. Because of the nature of the equipment used to print the cancellation mark 45 no attempt is made to place the cancellation mark 45 other than to ensure the cancellation mark is printed across a portion of the stamp 30. As previously discussed the support layer 35 is such that it will accept the cancellation mark 45.

Figure 4C:
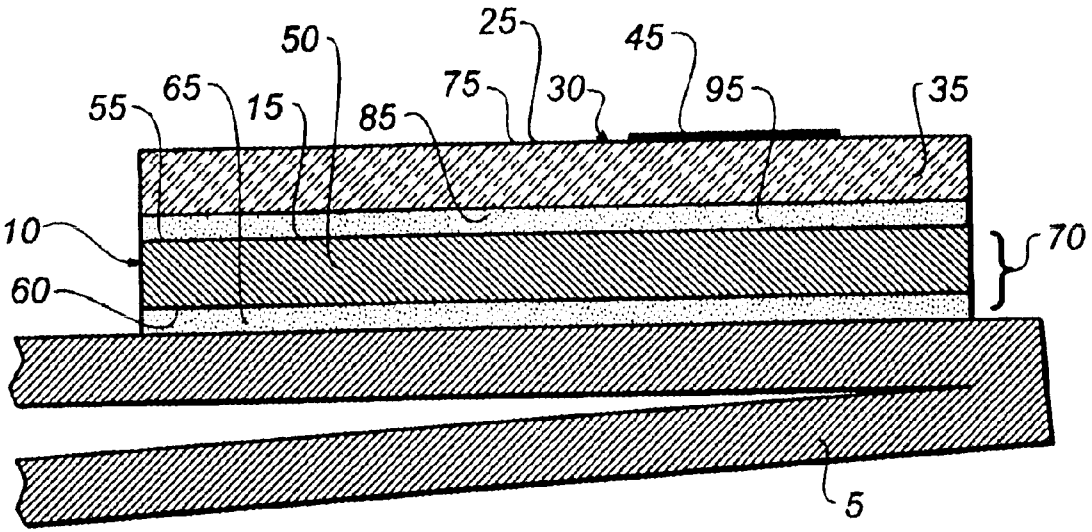
FIG. 4*c* is cross-sections view 4*c*—4*c* of FIG. 4*a*.

Referring now to FIG. 4*c*, there is illustrated across-sections view taken along line 4*c*—4*c* of FIG. 4*a*. The personal postal product 10 comprises label 70 having a first planner support structure 50 having a top surface 55 and a bottom surface 60. The top surface 55 having a personal image 15. The first planner support structure 50 also having a bottom surface 60, having an adhesive layer 65. The stamp 30 comprises the first planner transparent support 35 having a top surface 75 and a bottom surface 85, the top surface having the official postal image 25 as previously discussed. The bottom surface 85 is temporarily adhesively affixed to support structure 50 for later removal. For example the stamp 30 is affixed to top surface 55 of the label 70 via an adhesive 95 such as a reposition adhesive such as the adhesive used in 3M™ Scotch® 859 Removable Mounting Squares and 3M™ Scotch® Repositionable Glue Tape 928-100. The adhesive 65 allows the stamp 30 with the cancellation mark 45 to be removed from the personal postal product 10 by removing the support 35 without damaging the personal image 15 as shown in FIGS. 4*a* and 4*b*. Likewise the adhesive used to affix the personal postal product 10 to the envelope 5 can be of the same type of adhesive used to temporarily adhesively affix the support 35 as previously discussed. By using the repositionable type adhesive the personal postal image 15 can easily be removed from the envelope 5 to be saved for example in a scrapbook.

Figure 4D:
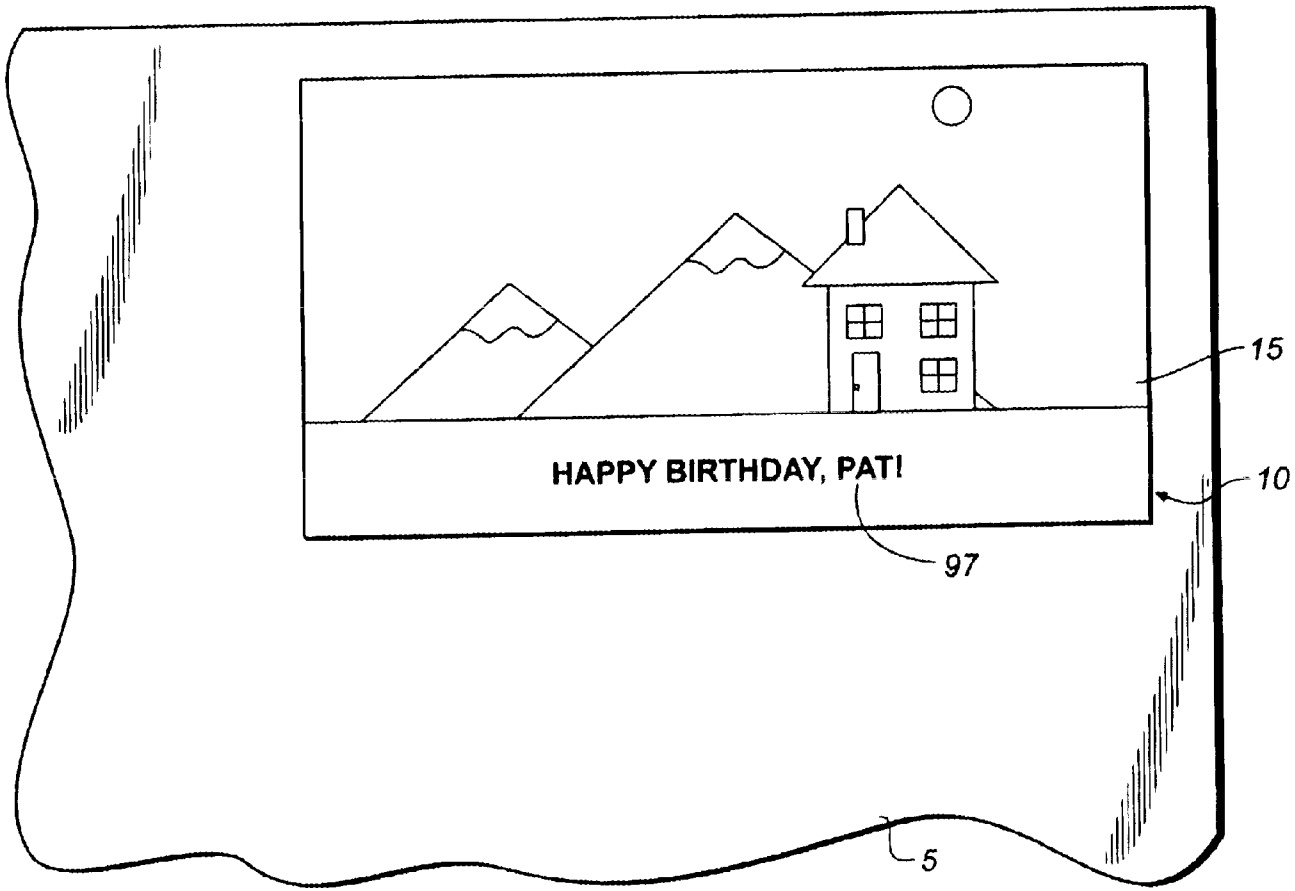
FIG. 4*d* illustrates a modified personal postal product where support is of a color, made in accordance with the present invention.

FIG. 4*d* illustrates a modified embodiment where support 35 is of a color, for example red, blue, green, or yellow. The colored support 35 when removed will reveal a hidden image or text 97 such as shown in FIG. 4*d*. It is of course understood that any hidden image or message may be provided.

Figure 5A:
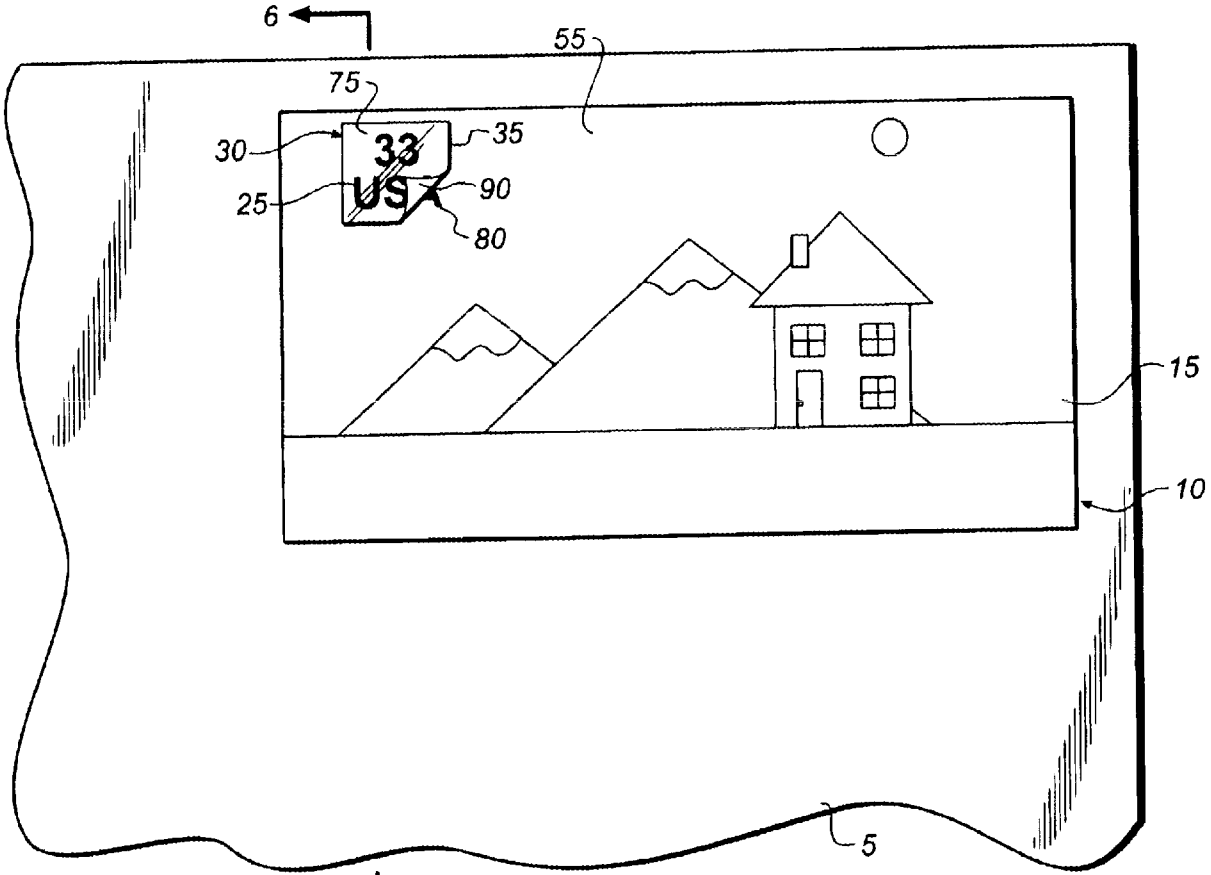
FIG. 5*a* and FIG. 5*b* are an enlarged view of an envelope affixed with a personal image and an official postal image made in accordance with the present invention.

Referring to FIG. 5*a*, there is illustrated an enlarged view of an envelope 5 affixed with a modified personal postal product 10 containing a personal image 15 for receiving an official postal product 30 thereon. As previously discussed in FIG. 1 like numerals indicating like parts and operations. The personal postal product 10 having a stamp 30 with official postal indicia 25 printed on the transparent support 35. In this embodiment the postal indicia 25 is a dry transfer 80.

Figure 5B:
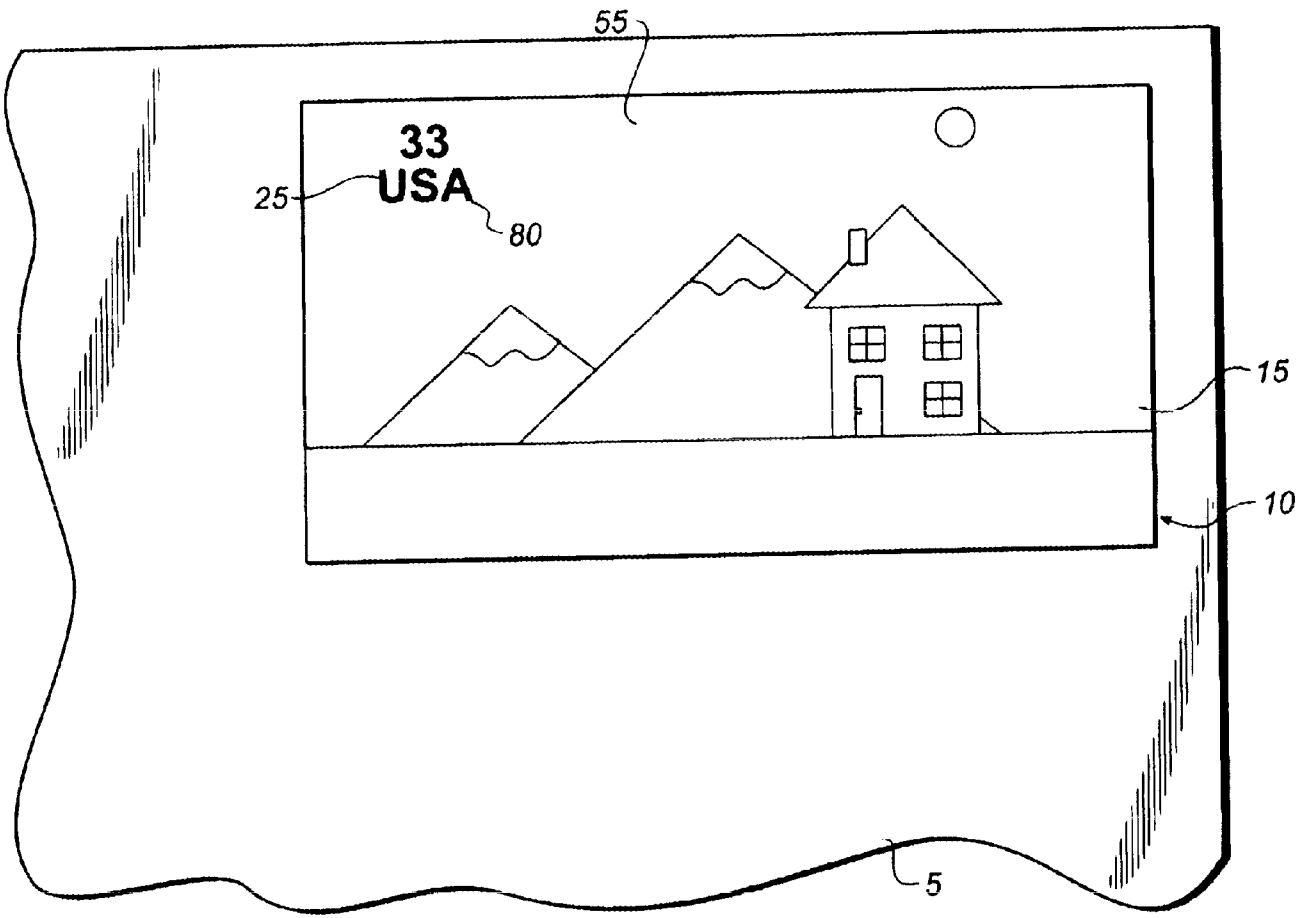
Figure 6:
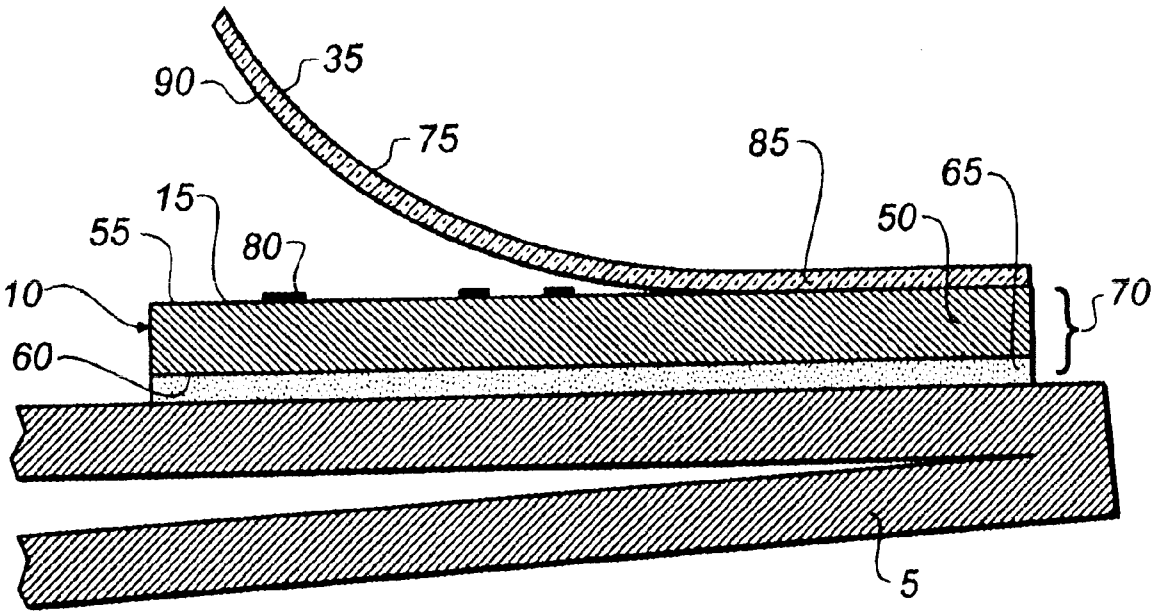
FIG. 6 is cross-sections view 6—6 of FIG. 5*b*.

Referring now to FIG. 6, there is illustrated across-sections view taken along line 6—6 of FIG. 5*b*. The personal postal product 10 comprises label 70 having a first planner support structure 50 having a top surface 55 and a bottom surface 60. The top surface 55 having a personal image 15 (as shown in FIG. 1). The first planner support structure 50 also having a bottom surface 60, having an adhesive layer 65. The official postal product 30 comprises transparent support 35 having a having a top surface 75 and a bottom surface 90, the bottom surface having the official postal indicia 25 in the form of a dry transfer 80. Dry transfers or dry-letter rub-offs can be letters, numbers and/or symbols that are printed on the under side of a transparent material such as a thin sheet of plastic. An example of a dry transfer or dry-letter rub-offs is Black and White Dry—Letter Rub-Off Sheets, Catalog # 826-2 Pelco®, MicroscopyMART Pelco International. As previously discussed in the case of stamps the dry transfers would be official postal indicia 25 in the form of a monetary value, a country and other required official symbols and in the required colors.

Referring back to FIG. 5*a*, the stamp 30 is position on the top surface of the personal postage product 10 and pressure is applied to the top surface 75 of the transparent support 35 as those who are skilled in the art would do to transfer a dry-letter rub off. The transparent support 35 is then removed leaving the official postal indicia 25 in the form of individual letters, numbers and symbols affixed to the top surface 55 of the personal postage product 10 as shown in FIG. 5*b*.

Figure 7:
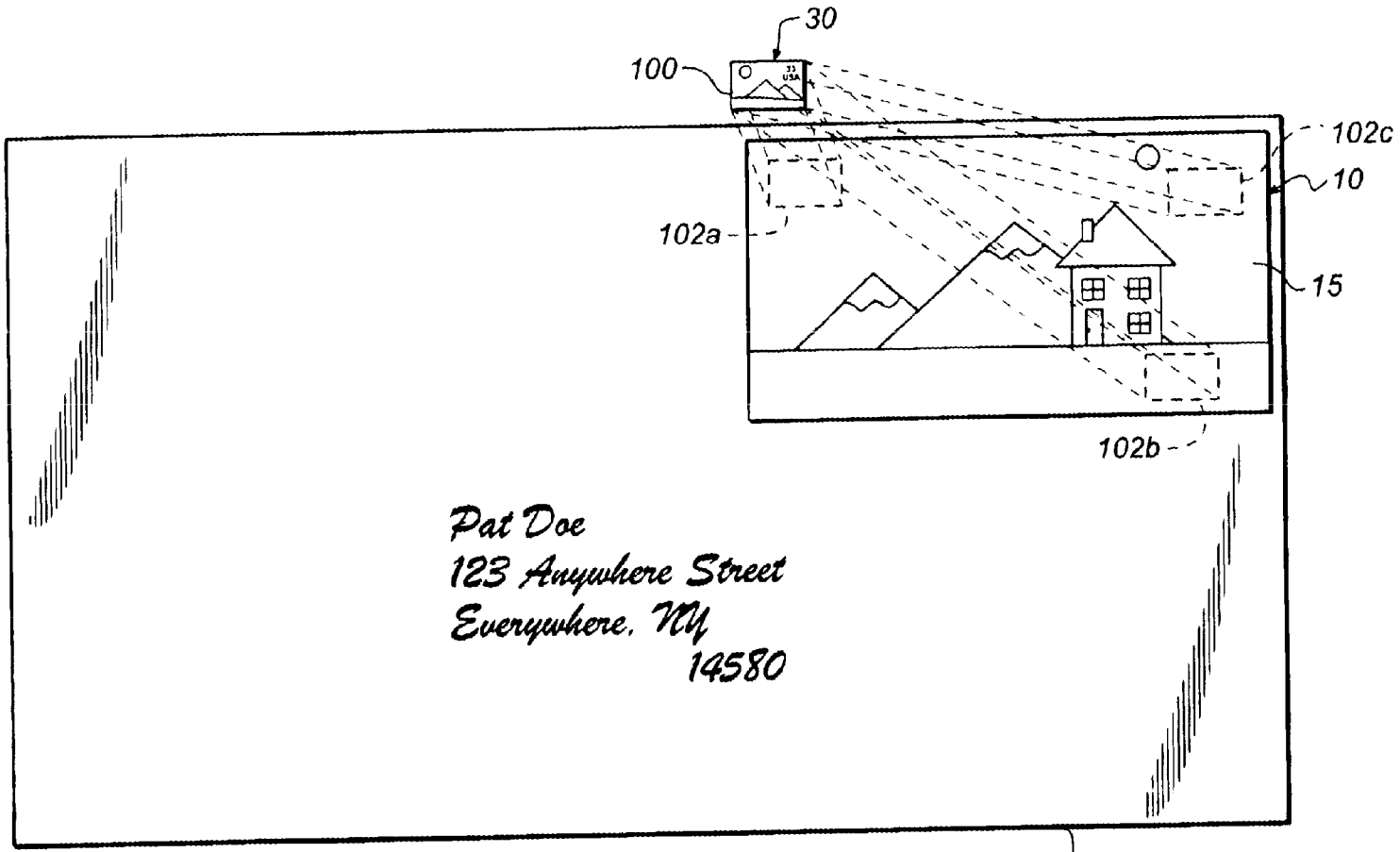
FIG. 7 is an plan view of an envelope affixed with a modified personal image and an official postal image made in accordance with the present invention.

Referring now to FIG. 7, there is illustrated a plan view of an envelope 5 illustrating where the stamp 30 may be placed on the personal postal product 10. As previously discussed in FIG. 1 like numerals indicating like parts and operations. The personal postal product 10 having a official postal product 30 with an official postal image 100 printed thereon. The official postal product 30 is reduced in sized for example less than 25% Or 50% of a stamp. The reduction in the size of the official postal product 30 provided greater latitude in where the stamp maybe affixed to the personal postage product 10. The stamp maybe affixed anywhere within the personal image 15 on the personal postal product 10 as indicated by the dashed rectangles 102*a*, 102*b*, and 102*c*. This allows the user to choose the most favorable place on the personal image 15 for placement of the stamp 30.

Figure 8:
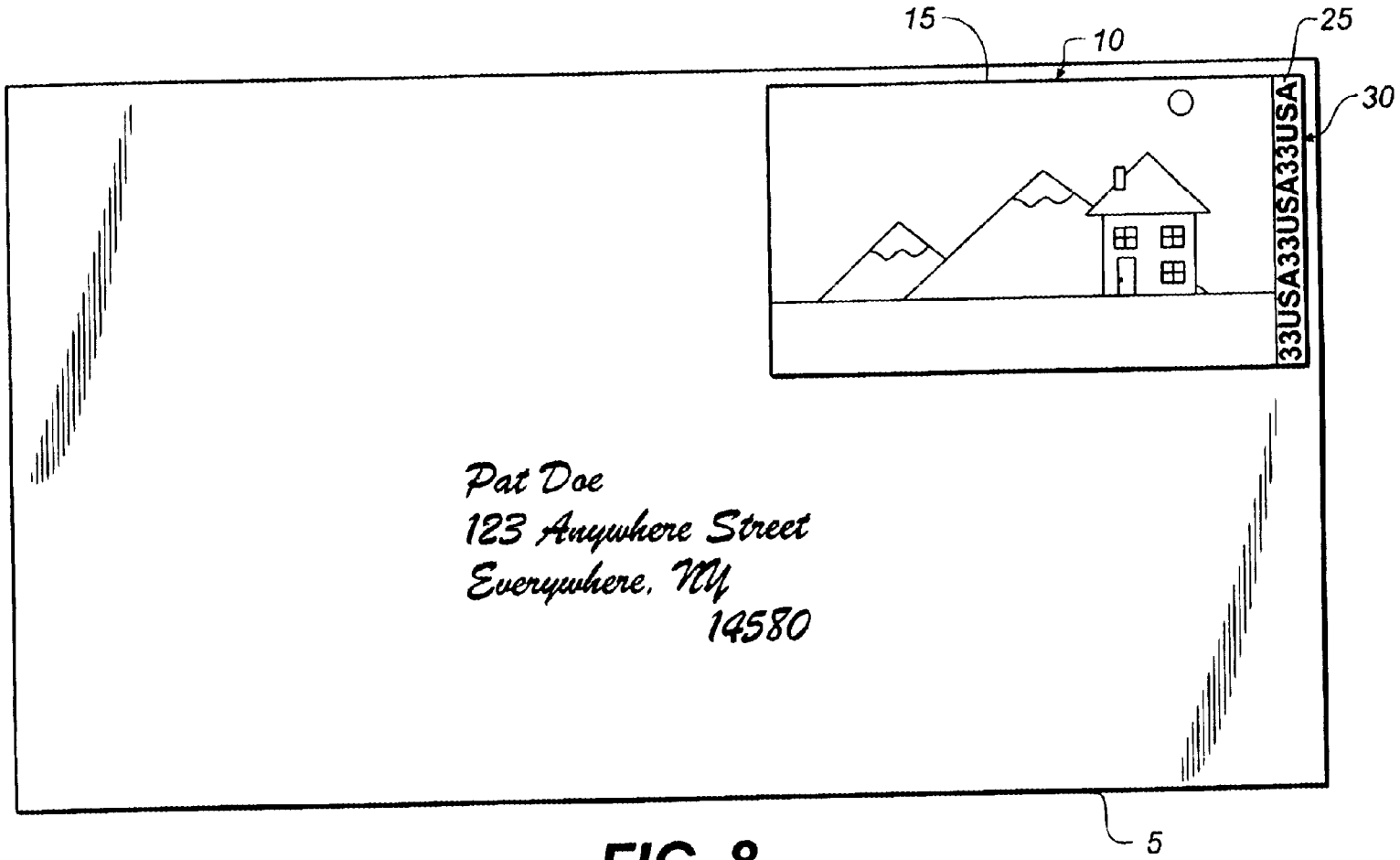
FIG. 8 is a plan view of an envelope affixed with a yet another modified personal image and an official postal image made in accordance with the present invention.

Referring now to FIG. 8, there is illustrated a plan view of an envelope 5 affixed with yet another modified personal postal product 10 containing a personal image 15 and a stamp 30. As previously discussed in FIG. 1 like numerals indicating like parts and operations. The personal postal product 10 having a official postal product 30 having the official postal indicia 25 printed thereon. The official postal product 30 is modified in shape to better fit the personal image 15. In the example shown the official postal product 30 is a rectangular strip affixed in a vertical modality. The official postal product 30 maybe be affixed in a horizontally. As with the placement the shape of the official postal product 30 may also be modified to be less obtrusive when affixed to the personal image 15. In the embodiment illustrated the official postal product 30 is located at one end (side) of the personal image 15.

Figure 9A:
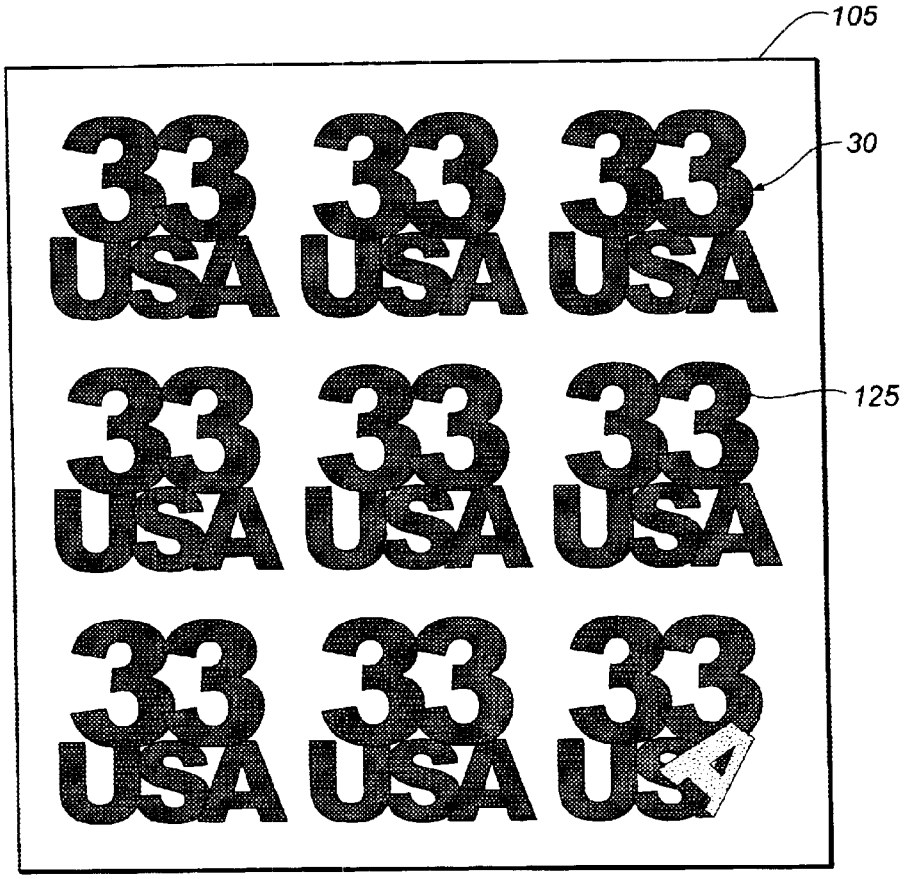
FIG. 9*a* is a view of a sheet of official postal indicia made in accordance with the present invention.

Referring now to FIG. 9*a* there is illustrated of a sheet 105 of modified official postal indicia 125. As previously discussed in FIG. 1 like numerals indicating like parts and operations. In this embodiment the official postal product 30 comprises just the indicia 25 in the form of the modified postal indicia 125. The postal indicia 125 can be lifted from the sheet 105 just as the pressure sensitive adhesive U. S. postage stamps.

Figure 9B:
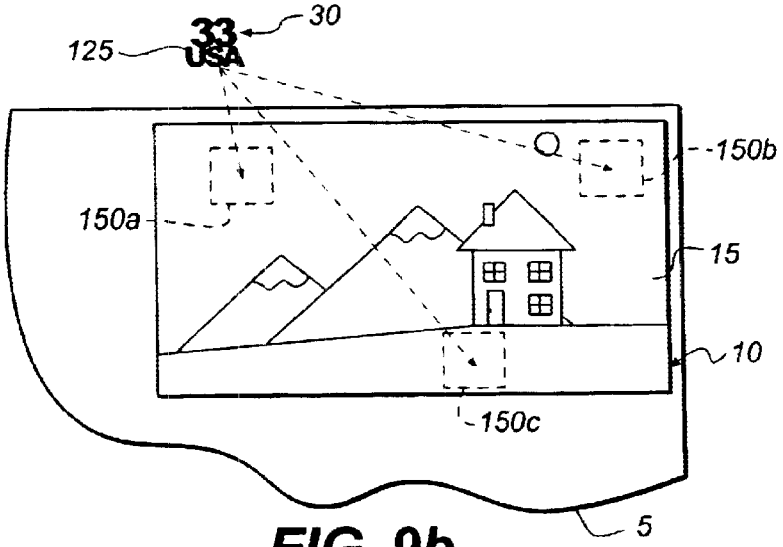
FIG. 9*b* is an enlarged partial view of an envelope affixed with a personal image and an official postal image of FIG. 9*a*.

Now referring to FIG. 9*b* there is illustrated an enlarged partial view of an envelope 5 affixed with a personal image 15. The stamp 30 in the form of the official postal indicia 125 maybe affixed anywhere within the personal image 15 on the personal postal product 10 as indicated by the dashed rectangles 150*a*, 150*b*, and 150*c*.

Figure 10:
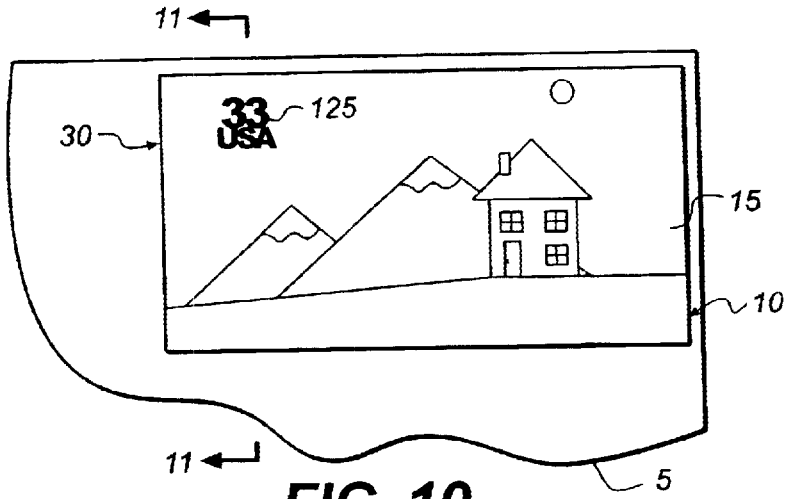
FIG. 10 is an enlarged partial view of an envelope affixed with a modified personal image and an official postal image of FIG. 9*a* made in accordance with the present invention.

Referring now to FIG. 10 there is illustrated a plan view of an envelope 5 affixed with a personal image 15 and the official postal indicia 125 of FIG. 9*a*.

Figure 11:
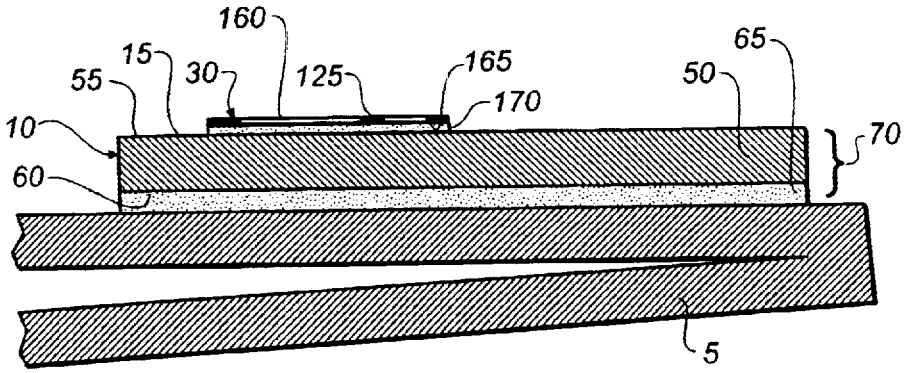
FIG. 11 is cross-sections view 11—11 of FIG. 10.

Referring now to FIG. 11, there is illustrated across-sections view taken along line 11—11 of FIG. 10. The personal postal product 10 comprises label 70 having a first planner support structure 50 having a top surface 55 and a bottom surface 60.The top surface 55 having a personal image 15 (as shown in FIG. 1). The first planner support structure 50 also having a bottom surface 60, having an adhesive layer 65. The stamp 30 comprises the modified postal indicia 125 having a having a top surface 160 and a bottom surface 165, the bottom surface having the adhesive 170.

The invention has been described in detail with particular reference to certain preferred embodiments thereof, but it will be understood that variations and modifications can be effected within the scope of the invention, the present invention being deferred by the following claims.

PARTS LIST

| | |
|---|---|
| 5 | Envelope |
| 10 | Personal postal product |
| 15 | Personal image |
| 25 | Official postal indicia |
| 30 | Stamp |
| 35 | Transparent support |
| 40a | Dashed rectangle |
| 40b | Dashed rectangle |
| 40c | Dashed rectangle |
| 45 | Cancellation mark |
| 50 | First planner support structure |
| 55 | Top surface |
| 60 | Bottom surface |
| 65 | Adhesive layer |
| 70 | Label |
| 75 | Top surface |
| 80 | Dry transfer |
| 85 | Bottom surface |
| 90 | Bottom surface |
| 95 | Adhesive |
| 97 | Text |
| 100 | Official postal image |
| 102a | Dashed rectangle |
| 102b | Dashed rectangle |
| 102c | Dashed rectangle |
| 105 | Sheet |
| 125 | Official postal indicia |
| 150a | Dashed rectangle |
| 150b | Dashed rectangle |
| 150c | Dashed rectangle |
| 160 | Top surface |
| 165 | Bottom surface |
| 170 | Adhesive |

What is claimed is:

1. A postal assembly comprising:

a first planner support structure having a top surface, said top surface having a personal image therein;

an official postal product having a second planner support structure, said second support structure being substantially clear, said official postal product has an official postal indicia printed on a portion thereof and is adapted to be placed on said first planner support structure over said personal image.

2. A postal assembly according to claim 1 wherein said image being a designated area where said official postal is preferably placed.

3. A postal assembly according to claim 1 wherein said bottom surface of first planner structure has an adhesive.

4. A postal assembly according to claim 1 wherein said bottom surface of first planner structure is an envelope.

5. A postal assembly according to claim 1 wherein said bottom surface of first planner structure is a label.

6. A postal assembly according to claim 3 wherein said second planer support is less than 25% of said first planer structure.

* * * * *